US005520225A

United States Patent [19]

Quigley et al.

[11] Patent Number: 5,520,225

[45] Date of Patent: May 28, 1996

[54] POCKET ARRANGEMENT IN THE SUPPORT SURFACE OF A WOVEN PAPERMAKING FABRIC

[75] Inventors: Scott Quigley, Simpsonville; Volker Ostermayer, Greenville, both of S.C.

[73] Assignee: Wangner Systems Corp., Greenville, S.C.

[21] Appl. No.: 376,224

[22] Filed: Jan. 23, 1995

[51] Int. Cl.[6] ..... D03D 13/00

[52] U.S. Cl. ..... 139/383 A

[58] Field of Search ..... 139/383 A

[56] References Cited

U.S. PATENT DOCUMENTS

| | | | |
|---|---|---|---|
| Re. 33,195 | 4/1990 | McDonald et al. | 139/383 A |
| 3,974,025 | 8/1976 | Ayers . | |
| 4,157,276 | 6/1979 | Wandel et al. | 139/383 A |
| 4,161,195 | 7/1979 | Khan | 139/383 A |
| 4,239,065 | 12/1980 | Trokhan . | |
| 4,376,455 | 3/1983 | Hahn | 139/383 A |
| 4,425,392 | 1/1984 | Oikawa et al. | 139/383 A |
| 5,052,448 | 10/1991 | Givin | 139/383 A |
| 5,169,711 | 12/1992 | Bhatt et al. | 139/383 A |
| 5,228,482 | 7/1993 | Fleischer | 139/383 A |
| 5,297,590 | 3/1994 | Fleischer | 139/383 A |

*Primary Examiner*—Andy Falik

*Attorney, Agent, or Firm*—Henry S. Jaudon; Cort Flint

[57] ABSTRACT

A woven fabric for use on papermaking machines having first and second sets of filaments interwoven with each other to provide a first grouping of coplanar top surface crossovers and a second grouping of recessed sub top surface crossovers. The first grouping of top surface crossovers are in spaced relation to define a plurality of at least first and second cavities. The first ones of the cavities are arranged along substantially parallel lines in the cross machine direction and the machine direction. The second ones of the cavities are spaced from the first ones of the cavities and are arranged along substantially parallel lines which extend in both the cross machine direction and the machine direction. Individual ones of the first cavities are arranged adjacent of and are interconnected with individual ones of the second cavities. The interconnected first and second cavities form cavity pairs.

19 Claims, 6 Drawing Sheets

POCKET ARRANGEMENT IN THE SUPPORT SURFACE OF A WOVEN PAPERMAKING FABRIC

BACKGROUND OF THE INVENTION

This invention relates to a dryer fabric for the formation of soft absorbent, wet-laid imprinted creped paper which is characterized by multi-cavity pockets arranged in randomly arranged appearing patterns over the support surface.

Creped paper which presents a surface texture which is pleasing to the eye and yet possesses a soft feel, a high absorbency capacity, good strength and good stretch characteristics, has long been recognized as a product in demand. Numerous attempts have been made to produce forming dryer fabrics which form such a product with varying degrees of success.

A dryer fabric for the formation of creped paper is disclosed in U.S. Pat. No. 3,974,025 to Ayers. This fabric, as disclosed by Ayers, is formed with spaced rows, comprised of diamond shaped patterns, which extend transversely thereof. The patent discloses using the back side of the drying fabric which is woven in a twill or semi-twill weave.

Yet another dryer fabric for the formation of creped paper is disclosed in U.S. Pat. No. 4,239,065 to Trokham. The patent discloses using imprinting fabrics woven in various twill and semi-twill weave patterns. An Atlas weave pattern is preferred. It is of particular relevance to note that the forming fabrics used in the production of paper in Trokham have been heat set to provide that certain of the warp and the weft present knuckles having top surfaces which lie along a common plane. Certain other of the warp is controlled to present knuckles which lie along a sub-top surface plane.

The pockets formed on the support surface of the prior art patents are generally uniform in shape and extend uniformly either transversely or diagonally across the fabric.

SUMMARY OF THE INVENTION

The instant invention has as its object the formation of a papermaking fabric in which pockets are formed over the support surface in a manner which appears random or non uniform.

Another object of the instant invention is the provision of a papermaking fabric having interconnected pockets arranged over its support surface.

Another object of the invention is the production of a papermaking fabric which produces crepe paper having pillows which are arranged over the surface of the paper in a non linear appearing manner.

Another object of the invention is the formation of a dryer fabric having multiple interconnected pockets arranged in opposing fashion over the support surface.

The instant invention is directed to a woven fabric for use on papermaking machines. These fabrics traditionally have a support surface and a running surface. The fabric comprises a first set of filaments which are disposed in a generally parallel relationship with each other in a first direction and a second set of synthetic filaments which are disposed in a generally parallel relationship with each other in a direction transverse of the first set of filaments.

The first and second sets of filaments are interwoven with each other to be serpentinely configured to provide a first grouping of coplanar top surface crossovers of the first and second sets of filaments and a second grouping of recessed sub top surface crossovers of at least one of the first and second set of filaments. The first grouping of top surface crossovers are in spaced relation to define a plurality of at least first and second cavities with the first ones of the cavities being arranged along substantially parallel lines in the cross machine direction and the machine direction. The second ones of the cavities are spaced from the first ones of the cavities and are arranged along substantially parallel lines which extend in both the cross machine direction and the machine direction. Individual ones of the first cavities are arranged adjacent of and are interconnected with individual ones of the second cavities. The interconnected first and second cavities form cavity pairs.

The cavity pairs formed by individual ones of the first set of machine direction cavities interconnect with individual ones of the second set of machine direction cavities and are arranged so that the cavities of the second set appear on alternate sides of the machine direction parallel lines along which the first set of cavities are aligned. The first cavities of the cavity pairs are arranged in adjacent pairs vertically along parallel lines in the machine direction while the second cavities of the cavity pairs are arranged in adjacent pairs horizontally along parallel lines in the cross machine direction. The points of connection for the first and second cavities extend along diagonal lines which are arranged transversely of the fabric. Each of the first and second cavities may encompass a pair of sub top surface crossovers.

The fabric may be woven in a six shed modified or broken twill weave or in a four shed modified twill weave.

The first and second group of yarns comprise machine direction yarns (MD) and cross machine direction yarns (CMD) which are synthetic monofilaments yarns. Normally the synthetic monofilaments are all of equal size and are formed of a polyester, a polyamide, a polyaryetherketones or a blend of polyester and polyamide. In certain instances the cross machine direction yarns may be larger than the machine direction yarns and in other instances they may be smaller than the machine direction yarns.

The fabric may be woven to form first, second, third, and fourth cavities. In this arrangement, the first cavities are interconnected with the second cavities to form first cavity pairs and the third cavities are interconnected with the fourth cavities to form second cavity pairs. The first cavity pairs and the second cavity pairs have C shape configurations and are arranged as opposed pairs uniformly over the support surface of the fabric.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
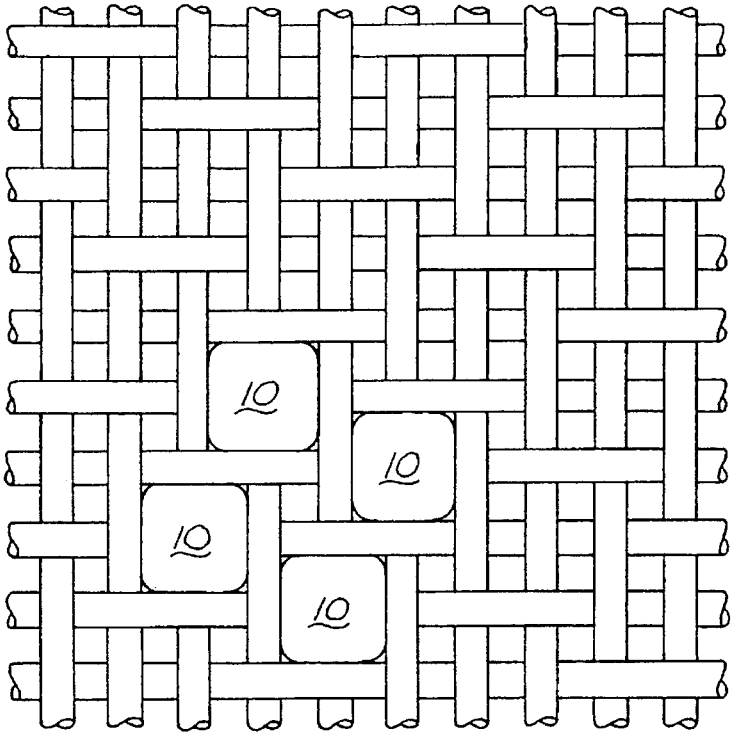
PRIOR ART Fig. 1
FIG. 1 is a fragmentary view of a prior art hybrid five shed papermaking fabric having diagonal rows of uniform pockets.
Figure 2:
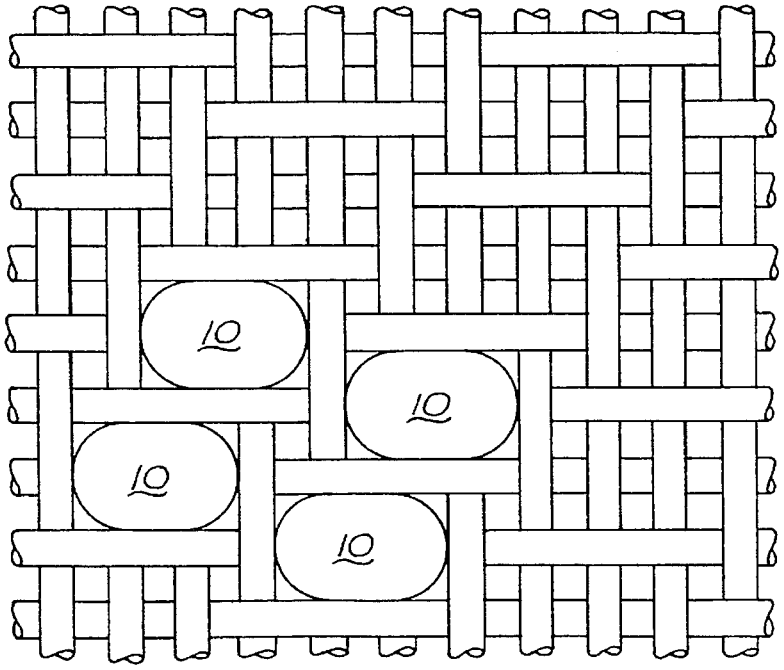
PRIOR ART Fig. 2
FIG. 2 is a fragmentary view of a prior art hybrid seven shed papermaking fabric having diagonal rows of uniform pockets.
Figure 3:
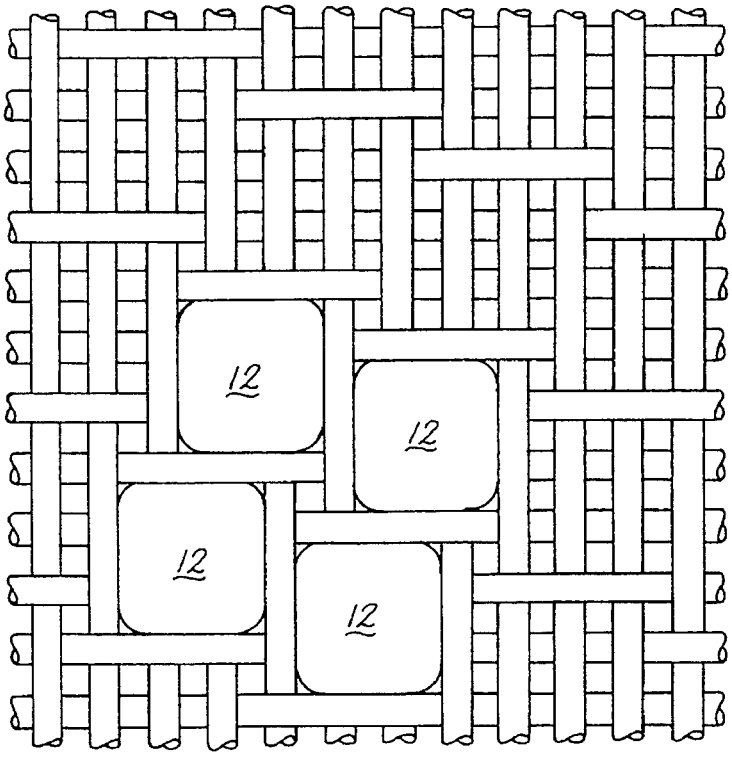
PRIOR ART Fig. 3
FIG. 3 is a fragmentary view of a prior art hybrid ten shed papermaking fabric having diagonal rows of uniform pockets.
Figure 4:
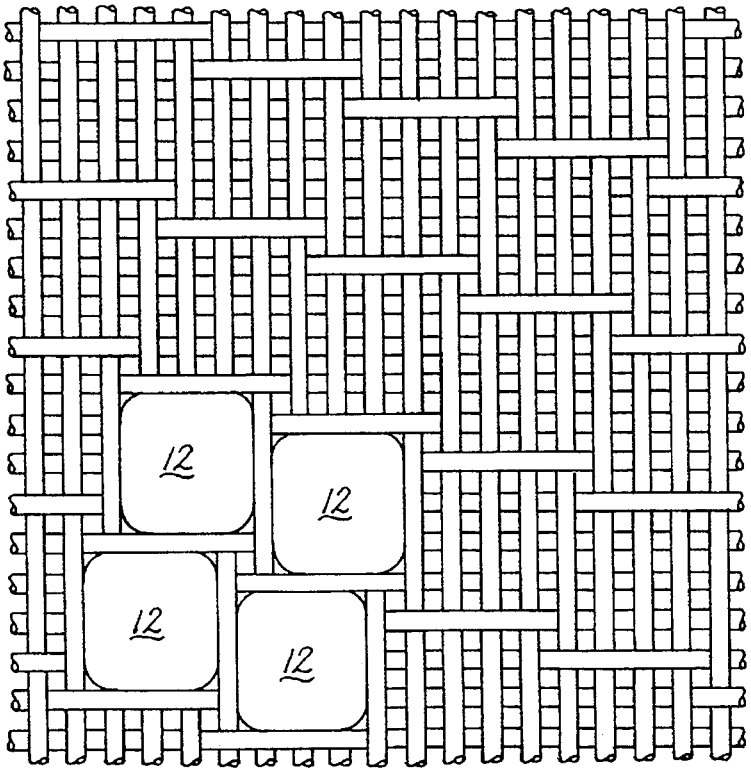
PRIOR ART Fig. 4
FIG. 4 is a fragmentary view of a prior art hybrid seventeen shed papermaking fabric having diagonal rows of uniform pockets.
Figure 5:
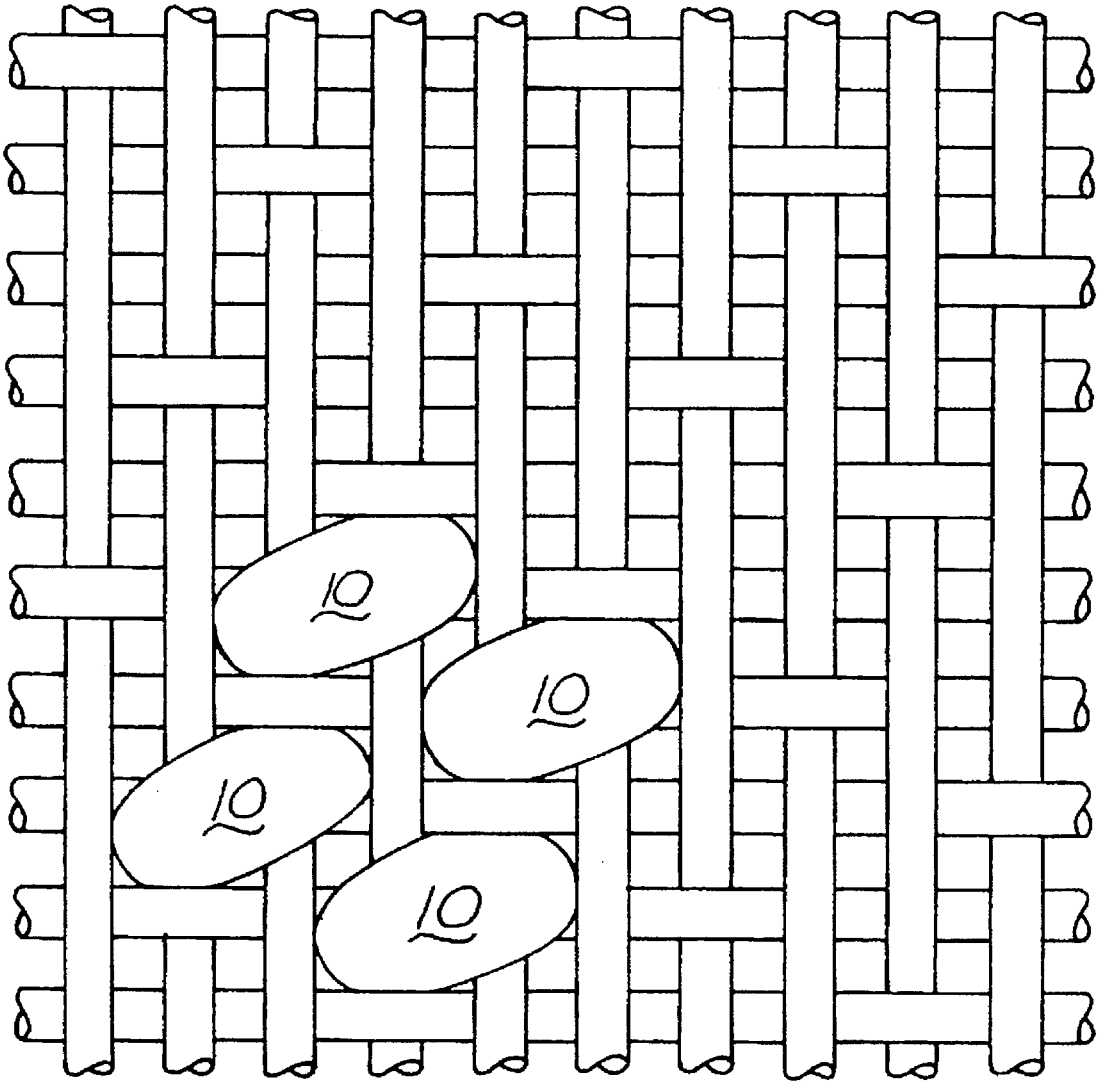
PRIOR ART Fig. 5
FIG. 5 is a fragmentary view of a prior art papermaking fabric, woven in five shed satin weave, having diagonal rows of uniform pockets.
Figure 6:
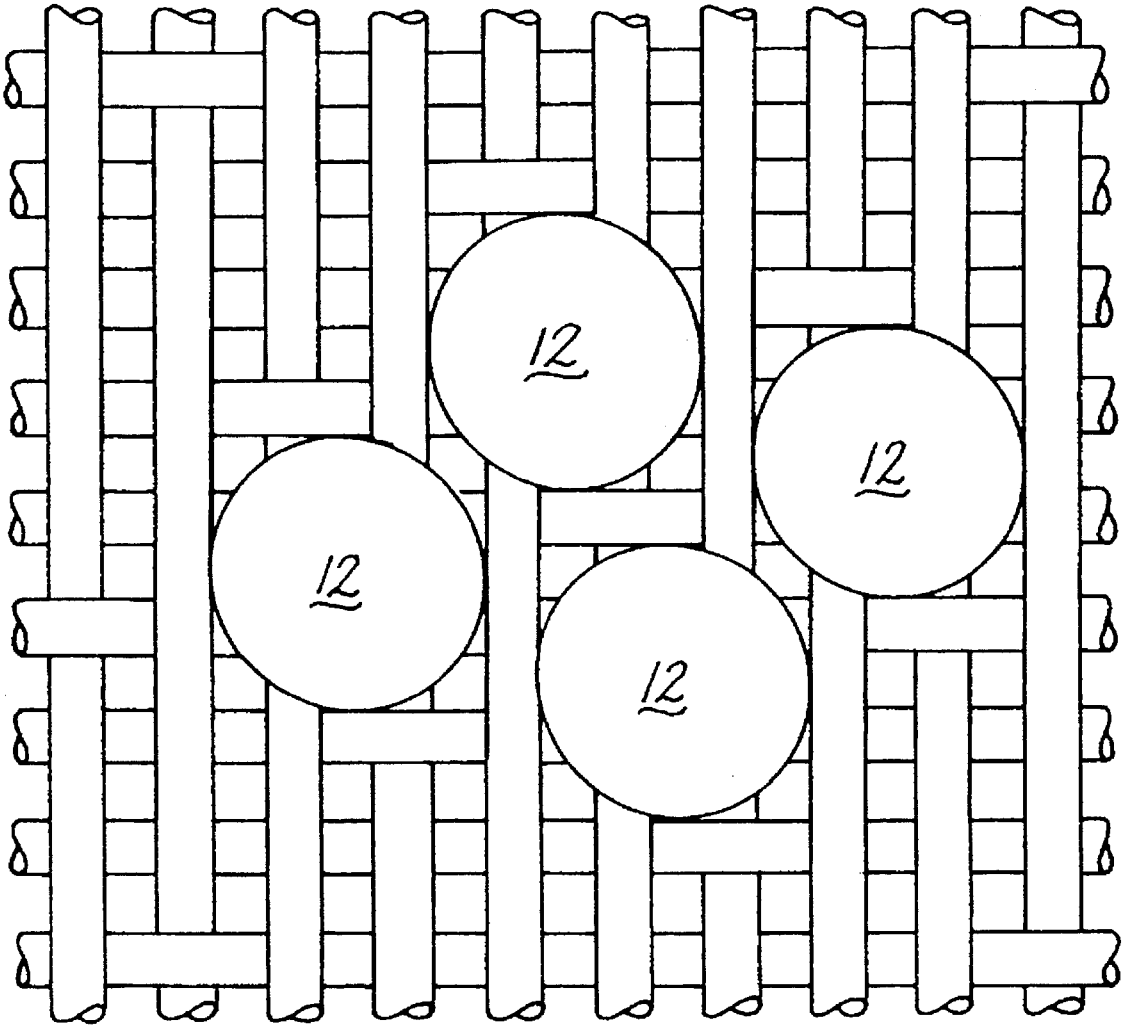
PRIOR ART Fig. 6
FIG. 6 is a fragmentary view of a prior art eight shed papermaking fabric having diagonal rows of uniform pockets.

Turning now to the drawings, FIGS. 1–6 show various well known support surface configurations for papermaking fabrics. FIGS. 1, 2, and 5 show papermaking fabrics in which pockets 10 formed on the support surface are arranged in diagonal rows along the length of the fabric and in parallel rows along a single pick transversely of the fabric. FIGS. 3, 4, and 6 show papermaking fabrics in which pockets 12 formed on the support surface are arranged along diagonal rows while the transverse arrangement of the pockets are arranged over a plurality of picks and are slightly skewed. In each of these prior art arrangements, the pockets are symmetrically shaped and arranged along continuous parallel lines.

Figure 7:
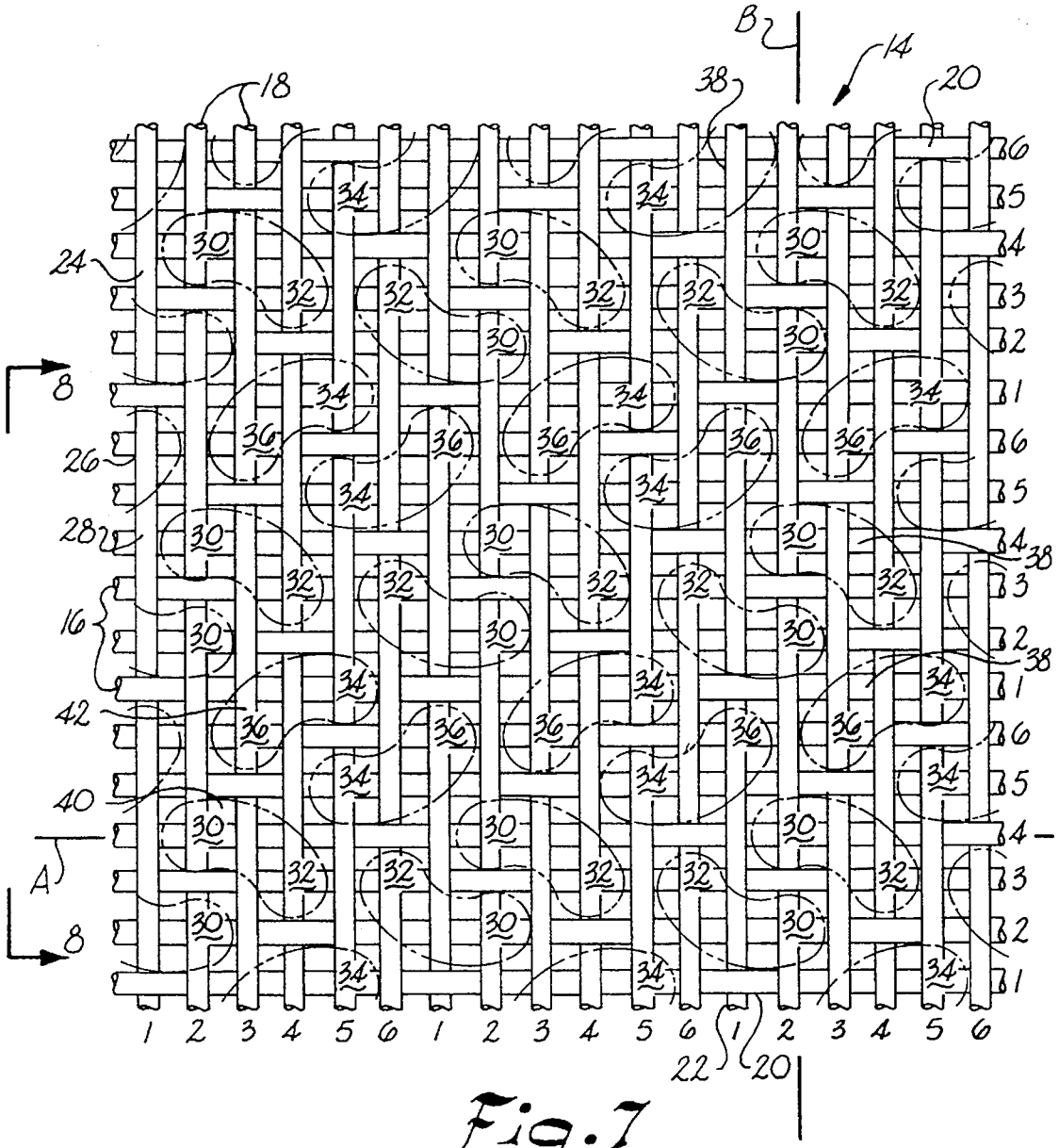
FIG. 7 is a fragmentary view of a papermaking fabric woven in a six shed modified twill with C shaped randomly arranged interconnected pocket pairs.
Figure 8:
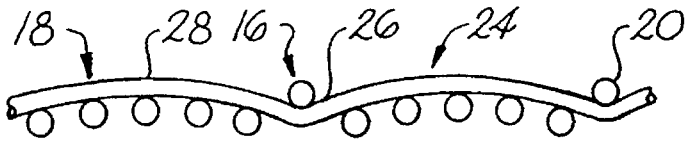
FIG. 8 is a side view of the fabric of FIG. 7 taken along lines 8—8.

Turning now to FIGS. 7 and 8, there is shown four repeats of papermaking fabric 14 woven in a six shed, six pick modified twill weave. The particular weave pattern has the first warp yarn (1) of warp yarns 18 of the weave pattern weaving under the first pick (1) of weft yarn 16 and over the remaining picks (2, 3, 4, 5, 6) of weft yarn 16. The second warp yarn (2) of warp yarn 18 weaves over picks (1 and 2) of weft yarn 16, under pick (3) and then over picks (4,5,6). The third warp yarn (3) of warp yarn 18 weaves over picks (1, 2, 3, 4). The fourth warp yarn (4) of warp yarn 18 weaves over the first (1) pick of weft yarn 16, under pick (2) and over pick (3, 4, 5, 6). The fifth warp yarn (5) of warp yarn 18 weaves over picks (1, 2, 3, 4, 5) of weft yarn 16 and under pick (6). The sixth (6) and final warp yarn of warp yarns 18 of the weave pattern weaves over picks (1, 2, 3) of weft yarn 16, under pick (4) and over picks (5, 6). This weave pattern creates cross machine direction (CMD) or cross fabric crossovers 20 which have their upper surfaces extending along a common plane over the support surface. Machine direction (MD) or fabric direction crossovers 24 are created with portions of their top surfaces extending along the referred to common plane at 28 and other portions of these crossovers extending along a sub-support surface plane creating sub-support crossovers 26. These sub-support surface crossovers 26 form separate pockets 30, 32, 34, and 36 which are defined by support surface crossovers 20, 24 along areas 28 and as indicated by the crossovers identified with an X.

Pockets 30, 32 are interconnected at 38 forming a first group of pocket pairs 40. Pockets 34, 36 are also interconnected at 38 forming a second group of pocket pairs 42 which are mutually exclusive from said first group of pocket pairs. Pocket pairs 40, 42 are each shaped in somewhat of a C or crescent configuration.

Pocket pairs 40 are arranged with first pockets 30 arranged along a common axis both along the fabric length as indicated by line B and transverse the fabric as indicated by line A. Second pockets 32 of pocket pairs 40 are similarly arranged along different axis.

First pockets 30 of pocket pairs 40 are arranged in juxtadasposed pairs longitudinally of or along the fabric length while second pockets 32 are arranged in juxtadasposed pairs transversely of the fabric. Adjacent pocket pairs 40 are arranged in reverse configurations so that they appear to fit together or face each other.

Second pocket pairs 42 are arranged in alternating rows with first pocket pairs 40. Second pocket pairs consist of third pockets 34 and fourth pockets 36 interconnected at 38. Third pockets 34 are arranged over the support surface similarly to first pockets 30 and fourth pockets 36 are arranged similarly to second pockets 32. The longitudinal axes along which adjacent third pockets 34 are arranged are transversely offset from the longitudinal axes along which adjacent first pockets 30 are arranged. Transverse rows of fourth pockets 36 are separated longitudinally of the fabric by two rows of first pocket pairs 40.

The support surface of papermaking fabric 14 provides superior areas of sub-support surface pockets, defined by pocket pairs 40, 42 which provide well defined pillows over the paper surface. These pillows generate a paper which is soft to the touch and has superior absorptive powers. Ample compressed areas are formed over the paper surface by support surface crossovers 20 and 28 to provide sufficient strength to the paper and also to define the pocket areas.

Figure 10:
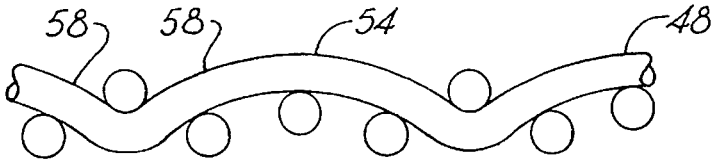
FIG. 10 is a side view of the fabric of FIG. 9 taken along lines 10—10 of FIG. 9.
Figure 9:
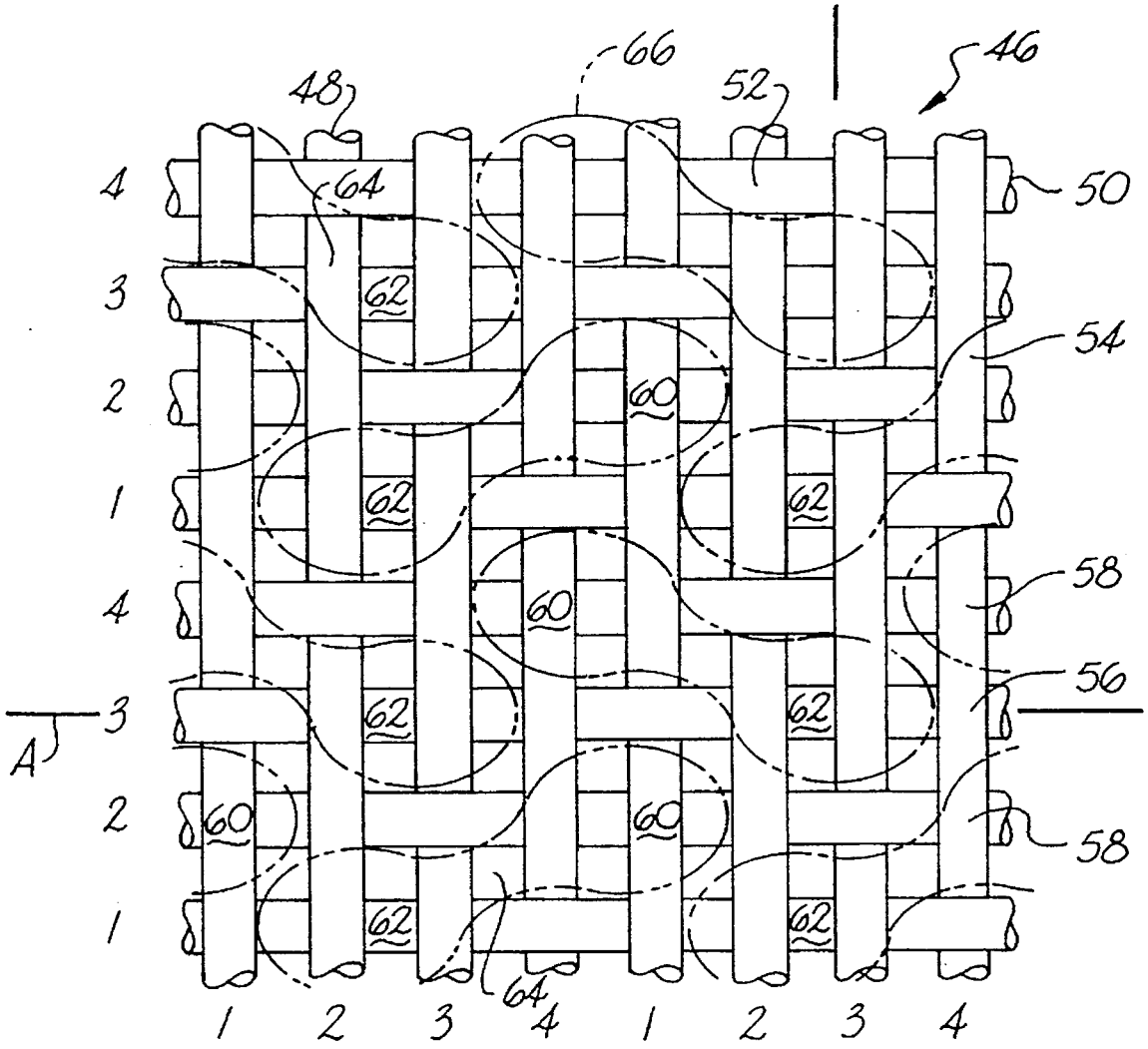
FIG. 9 is a fragmentary view of a papermaking fabric woven in a modified four shed twill weave with randomly arranged pocket pairs.

A second embodiment of the invention is shown in FIGS. 9 and 10. FIG. 9 is a fragmentary view showing four repeats of the weave pattern forming papermaking fabric 46. The weave pattern is a four shed broken twill in which four warp yarns 48 weave with four weft yarns 50.

As shown, the first warp yarn (1) warp yarns 48 passes over picks (1, 2) under pick (3) and over pick (4) of weft yarn 50. The second warp (2) of warp yarns 48 passes over pick (1, 2, 3) and under pick (4) of weft yarns 50. The third warp (3) of warp yarns 48 passes over pick (1) under pick (2) and over picks (3, 4) of weft yarn 50. The fourth (4) and final warp yarns 48 passes under pick (1) and over picks (2, 3, and 4) of weft yarn 50 to complete the weave pattern.

The support surface of papermaking fabric 46 is composed of cross machine direction crossovers 52 formed by weft yarns 50 which provide upper surfaces along a generally common plane. The machine direction (MD) crossovers 54 formed by warp yarns 48 provide upper surfaces at 56 which extend along the same plane as CMD crossovers 52 and other crossover surfaces 58 which extend along a sub support surface common plane. These sub support surface crossovers 58 create first pockets 60 and second pockets 62. First and second pockets 60, 62 are interconnected at 64 to form pocket pairs 66. Pocket pairs 66 are arranged so that first pockets 60 are arranged along common axes transverse and longitudinally the fabric 46. Second pockets 62 are also arranged to appear along common axes transverse and longitudinally of fabric 46. First and second pockets 60, 62 are arranged adjacent each other longitudinally of the fabric. First pockets 60 are separated by second pockets 62 as they appear transversely of fabric 46.

Again the support surface of fabric 46 provides ample cavity or pocket area to produce paper in which a major portion of its surface consist of pillows of uncompressed fibers circumscribed by lineaments of compressed fibers created by the support surface crossovers.

It is preferred that the dryer fabrics of the preferred embodiments of the invention be woven of monofilament synthetic yarns formed of polyamide, polyester, polyaryletherketones or a blend thereof. Multifilament yarns could also be employed as warp, weft or both. The yarns are preferably between 0.14 and 1.0 mm in diameter and are of one size or variable sizes in the warp and/or weft. The fabric may be woven with a count of between 10×10 to 120×120 filaments per inch. Using 0.4 mm filaments, a count of 40×40 is preferred.

While a preferred embodiment of the invention has been described using specific terms, such description is for illustrative purposes only, and it is to be understood that changes and variations may be made without departing from the spirit or scope of the following claims.

What is claimed is:

1. A woven fabric for use on papermaking machines having a support surface and a running surface, said fabric comprising;

a first set of filaments disposed in a generally parallel relationship and in a first direction;

a second set of synthetic filaments disposed in generally parallel relationship and transverse of said first set of filaments;

said first and second sets of filaments being interwoven with each other to be serpentinely configured to provide a first grouping of coplanar top surface crossovers of said first and second sets of filaments and a second grouping of recessed sub top surface crossovers;

said top surface crossovers being in spaced relation to define a plurality of at least first and second cavities;

said first cavities being arranged along substantially parallel lines in a cross fabric direction and a fabric direction;

said second cavities being spaced from said first cavities and arranged along substantially parallel lines in both the cross fabric direction and the fabric direction; and individual ones of said first cavities being interconnected with individual ones of said second cavities to form mutually exclusive cavity pairs said first and second cavities forming said cavity pairs being spaced both horizontally and vertically.

2. The fabric of claim 1 wherein said first set of filaments form said second grouping of recessed sub top surface crossovers.

3. The fabric of claim 2 wherein said first set of filaments extend in the fabric direction.

4. The fabric of claim 1 wherein ones of said first set of fabric direction cavities are arranged along first fabric direction longitudinal lines, said ones of said first set of fabric direction cavities interconnecting with ones of said second set of fabric direction cavities forming said cavity pairs in such a manner that said cavities of said second set of cavity pairs appear on alternate sides of said first fabric direction longitudinal lines along which said first set of cavities are aligned.

5. The fabric of claim 1 wherein said first cavities of said cavity pairs are arranged vertically in adjacent pairs along parallel lines in said fabric direction.

6. The fabric of claim 1 wherein said second cavities of said cavity pairs are arranged horizontally in adjacent pairs along parallel lines in said cross fabric direction.

7. The fabric of claim 1 wherein said fabric is woven in a six shed modified twill weave.

8. The fabric of claim 1 wherein said fabric is woven in a four shed modified twill weave.

9. The fabric of claim 1 wherein each of said first and second cavities encompass a pair of subsurface crossovers.

10. The fabric of claim 1 wherein said fabric is woven to form first, second, third, and fourth cavities, said first cavities being interconnected with said second cavities forming first cavity pairs and said third cavities being interconnected with said fourth cavities forming second cavity pairs.

11. The fabric of claim 10 wherein said first cavity pairs and said second cavity pairs form opposed facing pairs of C shape configurations arranged over said support surface of said fabric.

12. The fabric of claim 1 wherein said fabric direction yarns and said cross fabric direction yarns comprise synthetic monofilament yarns.

13. The fabric of claim 12 wherein said synthetic monofilaments are of equal size.

14. The fabric of claim 12 wherein said synthetic monofilaments comprise one of polyester, polyamide, polyaryetherketones and a blend of a polyester and a polyamide.

15. The fabric of claim 12 wherein said cross fabric direction yarns are larger than said fabric direction yarns.

16. The fabric of claim 12 wherein said cross fabric direction yarns are smaller than said fabric direction yarns.

17. A woven dryer fabric for use in blow through dryers of papermaking machines, said fabric having a support surface which produces crepe paper having randomly appearing pillows, said fabric comprising:

a plurality of warp filaments extending generally longitudinally of the fabric;

a plurality of weft filaments extending generally transverse of the fabric;

said warp filaments being interlaced with said weft filaments to form longitudinal crossovers having upper surfaces extending generally along a first plane and a second plane;

said weft filaments being interlaced with said warp filaments to form transversely extending crossovers having upper surfaces extending generally along said first plane;

said warp and weft crossovers extending along said first plane defining interconnected mutually exclusive pocket pairs configured in a crescent like shape;

said crescent shaped pocket pairs being arranged in facing pairs over said support surface; whereby said support surface presents a plurality of pockets appearing to be randomly arranged.

18. The fabric of claim 17 wherein said crescent shaped pocket pairs are arranged in an offset manner substantially diagonally of said fabric.

19. The fabric of claim 17 where there are two sets of said crescent shaped pocket pairs, said sets being offset and arranged in alternating manner over said support surface.

* * * * *